US006502509B2

(12) United States Patent
Göttling et al.

(10) Patent No.: US 6,502,509 B2
(45) Date of Patent: Jan. 7, 2003

(54) PRINTING UNIT FOR A ROTARY PRINTING MACHINE WITH CROSS SLIDE

(75) Inventors: Josef Göttling, Friedberg (DE); Thomas Hartmann, Friedberg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/792,531

(22) Filed: Feb. 23, 2001

(65) Prior Publication Data

US 2001/0035104 A1 Nov. 1, 2001

(30) Foreign Application Priority Data

Feb. 23, 2000 (DE) ..... 100 08 215

(51) Int. Cl.[7] ..... B41F 13/14

(52) U.S. Cl. ..... 101/248; 101/480; 101/425; 101/481

(58) Field of Search ..... 101/DIG. 35, 486, 101/248, 247, 479, 481, 480, 425

(56) References Cited

U.S. PATENT DOCUMENTS

| | | | | |
|---|---|---|---|---|
| 3,136,245 A | | 6/1964 | Klingelfuss | 101/152 |
| 4,309,945 A | | 1/1982 | Marion | 101/247 |
| 5,347,926 A | * | 9/1994 | Fantoni et al. | 101/219 |
| 5,644,828 A | * | 7/1997 | Sailer et al. | 297/135 |
| 5,692,442 A | | 12/1997 | Leanna | 101/247 |
| 5,868,071 A | * | 2/1999 | Niemiro et al. | 101/218 |
| 6,085,650 A | | 7/2000 | Petersen | 101/220 |
| 6,308,627 B1 | * | 10/2001 | Konig et al. | 101/423 |
| 6,397,743 B1 | * | 6/2002 | Dauer et al. | 101/220 |

FOREIGN PATENT DOCUMENTS

| | | |
|---|---|---|
| DE | 711 160 | 9/1941 |
| DE | 195 34 651 | 3/1997 |
| DE | 693 05 768 | 5/1997 |

* cited by examiner

*Primary Examiner*—Daniel J. Colilla
(74) *Attorney, Agent, or Firm*—Cohen, Pontani, Lieberman & Pavane

(57) ABSTRACT

Rotary printing machine with forme and impression cylinders for variable-format or variable-circumference printing and with service apparatus which are capable of being moved radially in relation to the printing-unit cylinders for throw-on or throw-off movements and in the axial direction of the cylinders or in the side-wall plane. The service apparatus and the printing-unit cylinders are arranged on cross slides which can each be moved in two directions relative to the printing-unit side wall.

12 Claims, 2 Drawing Sheets

PRINTING UNIT FOR A ROTARY PRINTING MACHINE WITH CROSS SLIDE

PRIORITY CLAIM

This applications claims the priority of German Application No. 100 08 215.7, filed Feb. 23, 2000.

BACKGROUND OF THE INVENTION

1. Field of the Invention

The invention relates to a printing unit of a rotary printing machine having at least one forme cylinder and at least one impression cylinder which can be moved relative to each other, as well as service apparatus which can be moved relative to the cylinders.

2. Description of the Related Art

U.S. Pat. No. 6,085,650 discloses a printing unit for a rotary printing machine, in which the distance between the transfer cylinder and forme cylinder is adjustable. It is thereby possible to use cylinders with different diameters and to print with a variable circumference, that is to say a variable format. The adjustability of the printing-unit cylinders is made possible by slides which are guided linearly on carriers and on which the cylinders are mounted.

Multi-ring bearings, which make it possible by means of eccentrics to execute movements for throwing on or throwing off impression cylinders, are generally known in printing-machine construction. However, only very short adjustment travels are possible with these.

Proceeding from this the object of the invention is to provide a device which makes it possible to move and position both printing-unit cylinders and service apparatus assigned to these cylinders accurately in two different directions independent of one another.

SUMMARY OF THE INVENTION

According to the invention, at least one of the cylinders and the service apparatus are movable by means of a cross-slide unit which permits movement relative to the side wall in two transverse directions.

By the mounting the cylinders on a cross-slide units according to the invention, it is possible to position printing-unit cylinders both in their radial direction and in the axial direction. As a result, the axial distance between the forme and transfer cylinders can be adjusted for format matching and lateral registration can be carried out.

By means of the invention, it is possible in a simple way for the most diverse service apparatus such as, for example, imaging, fixing or erasing apparatus or coating apparatus for lithographic material, to be thrown radially onto or off forme cylinders and to be moved axially. Inking or dampening units or washing devices can, by means of positioning apparatus according to the invention, be aligned in terms of their vertical position with various cylinders and thrown on or off and can also be moved completely out of the region of a printing-unit cylinder.

By means of the positioning apparatus according to the invention, camera systems can also be adjusted to forme cylinders of different diameters and be moved in the axial direction or transversely to the axial direction for the purposes of checking the imaging or the print-carrier web.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
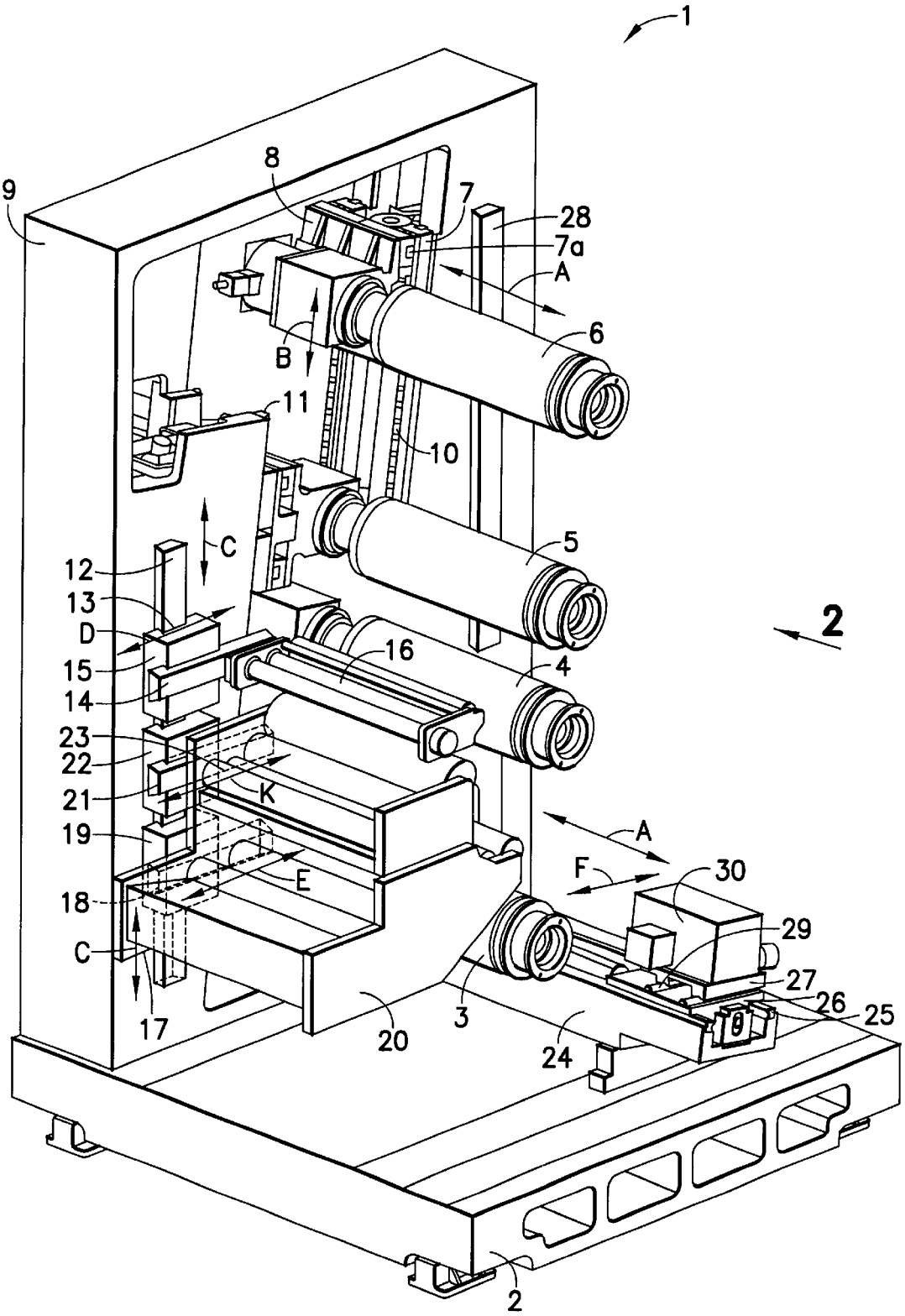
FIG. 1 shows a three-dimensional illustration of an exemplary printing unit.

FIG. 1 illustrates a three-dimensional view of a printing unit (1). In order to display the equipment, according to the invention, of this exemplary embodiment, an illustration of the front side wall and of other subassemblies not relevant for this purpose has been dispensed with.

The printing unit stands on a base plate (2) on which side wall (9) is supported. In exemplary embodiments with an overhung cylinder mounting, a second side wall may be dispensed with, so that the operating side is freely accessible.

The side walls (9) each have an aperture, at the two lateral boundaries of which guides (10, 11) are mounted essentially opposite one another. In this exemplary embodiment, two parallel rails are arranged as the first guide 10, in which a first slide (7) is guided. Arranged on first slide (7) is a second guide **(7*a*) which is rotated through ninety degrees in relation to the first guide (10) and carries a second slide (8). The mounting of the forme cylinder (6) is fastened on second slide (8) and also carries, next to the cylinder (6)**, the drive motor of the latter.

The forme cylinder (6) can be moved and positioned in the direction of the double arrow B by means of first slide (7), and can be moved and positioned in the axial direction indicated by double arrow A by means of second slide (8). This subassembly, designated as a cross slide (7+8), is also used for the mountings of the further printing-unit cylinders (3, 4, 5), the slides (7) of the respectively co-operating cylinders (6, 5; 5, 4; 4, 3) being arranged alternately on the guides (10, 11) located opposite one another. By virtue of the alternating arrangement, the slides (7) can have a longer construction, so that more favorable guidance conditions prevail (guide length to guide width) and forces can be introduced more effectively into the side wall. Since the cylinder mountings can nevertheless be positioned very close to one another, it is also possible to use cylinders with a very small diameter.

The moveability of the cylinders in the direction of the double arrow B allows format variability, and, by means of accurate positioning of the slide (8) in the direction of the double arrow A, the lateral register can be set. In the case of cylinders (3, 4, 5, 6) mounted on both sides, a cross-slide unit (7+8) is preferably arranged on the driving side and only an axially moveable radial bearing on a slide (7) is arranged on the other side. A cross-slide unit (7+8) may, of course, also be provided on both mounting sides of the cylinders. The drives of the various slides (7, 8) on the two mutually opposite bearing sides of the cylinders are activated in such a way that the bearing points move synchronously with one another.

The printing-unit cylinders (3, 4, 5, 6) are coupled to the mountings on both sides by means of releasable journals. In the case of cylinders arranged in an overhung manner, as shown, the cylinders are mounted on only one side. In order to change sleeves, these journals can be released on the operating side and the cylinder can be moved out of the region of engagement of the mounting in the axial direction (double arrow A) by means of the second slide (8). As soon as the released mounting has been moved away in the direction of the double arrow B by means of first slide (7), the end face of the printing-unit cylinder (3, 4, 5, 6) is accessible for drawing off or pushing on a sleeve.

In order to exchange the cylinder body, the free end can be coupled to a face transport arrangement, and, after releasing of the journal, the cylinder body can be extracted through the aperture in the side wall (9). Another cylinder, for example with a different diameter, can then be installed in reverse order.

Figure 2:
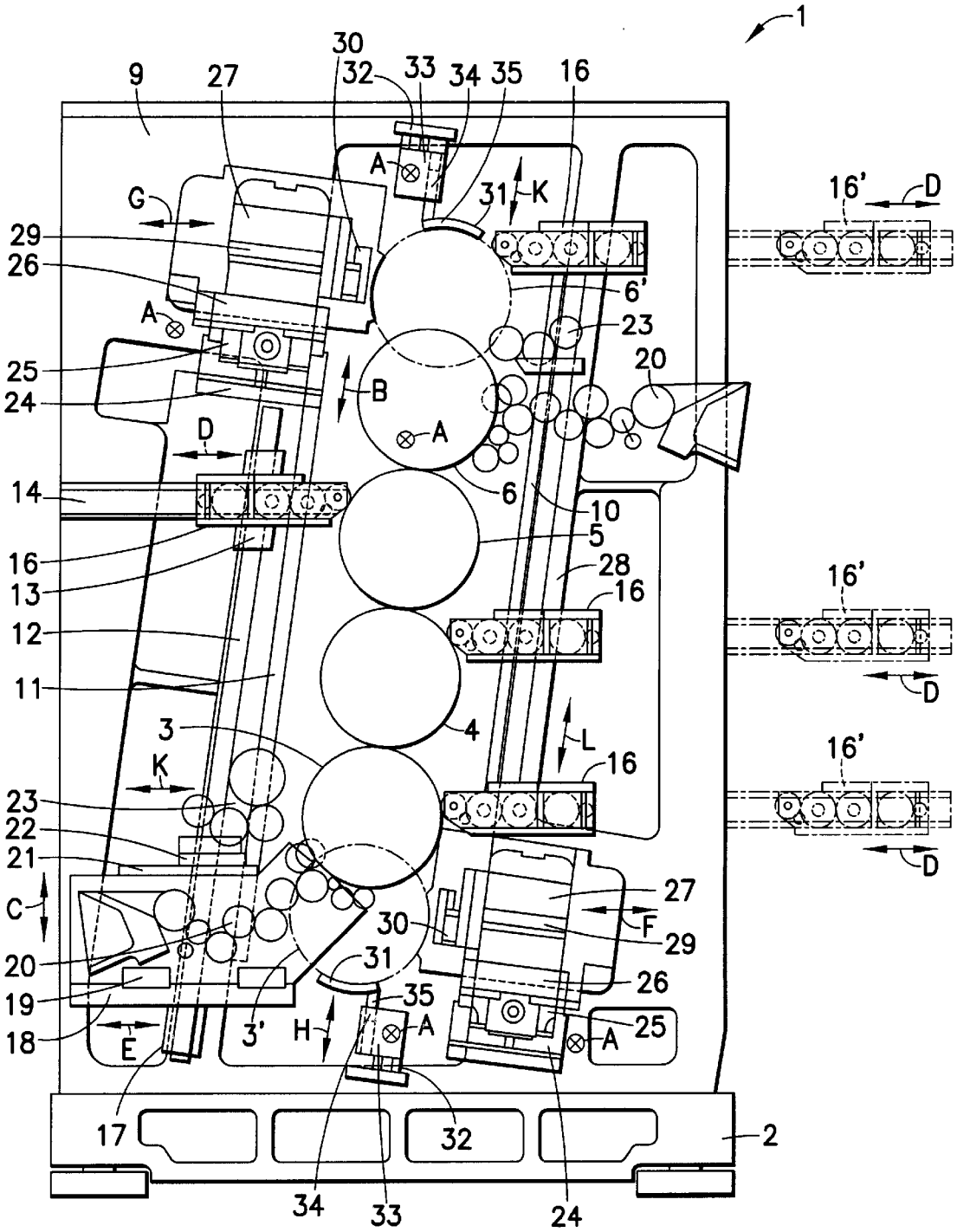
FIG. 2 shows a side view of the same printing unit in the direction of the arrow SR.

The first guides (10, 11) and the slides (7, 8) for moving and positioning the cylinders (3, 4, 5, 6) are arranged within the side walls (9). Corresponding first guides (12, 28) with slides for moving and positioning functional arrangements, such as inking/dampening units or washing/erasing arrangements, are arranged, for example, on the insides of the side walls (9). Preferably, these guides (12, 28) run parallel to the guides (10, 11) on which the cylinder mountings are arranged, as shown in FIG. 2.

The inking unit (20) assigned to the forme cylinder (3) is designed as a cassette, and a further inking unit is assigned in a similar way to the forme cylinder (6), but is not depicted for the sake of greater clarity. In this exemplary embodiment, the inking unit (20) is arranged on carriages (17) which can be moved towards the cylinder in the direction of the double arrow E on guide rails (18) and can be positioned in a controlled manner. These guide rails (18) are arranged on a further carriage (19) which moves in the direction of the double arrow C in the guide (12) arranged on the side wall. By the drive of the corresponding carriages (17, 19) being activated synchronously on both sides, the inking unit (20) can be adjusted in the direction of the double arrows C and E to the cylinder diameter installed in each case or be moved away during the movement of the cylinder (3, 6). On this cross-slide unit (17+19), a movement (C) leading obliquely upwards is coupled with a movement (E) running parallel to the baseplate (2). It is clear from this that the positioning axes (C, E) do not necessarily have to form a right angle.

In the case of printing-unit cylinders mounted in an overhung manner, the inking unit (20) is also guided on only one side by a cross-slide unit (17+19).

The top side of the cassette of the inking unit (20) has arranged on it further guide rails (21) with carriages (22), on which a cassette-like dampening unit (23) can be moved and positioned in the direction of the double arrow K. The guide rails (21) can both lie in a plane parallel to the guide rails (18) and form an angle, in terms of their directions of movement E and K.

Furthermore, it is also possible for the dampening unit (23) to be provided with its own cross-slide unit, so that it can be moved and positioned independently of the inking unit (20).

The other forme cylinder (6) is likewise assigned, in a similar way to this, an inking or dampening unit. Only the guide (28) which performs the same function as the guide (12) is depicted. The inking (20) and dampening (23) units are shown in FIG. 2.

Each printing-unit cylinder (3, 4, 5, 6) may be assigned a cassette-like washing/erasing device (16). When a rubber-blanket cylinder (4, 5) is used, such [awashing/erasing] a washing-erasing device (16) is operated as a conventional rubber-blanket washing arrangement, and, in use on a forme cylinder (3, 6), the imaging can be erased by means of basically the same washing/erasing device (16). Such a device is described in more detail in EM10412:

A washing/erasing device (16) is fixed to a carriage (15) which is driven to move the washing/erasing device (16) towards or away from the rubber-blanket cylinder (5) on guide rail (14) in the direction of the double arrow D. The guide rail (14) is fixed on a carriage (13) which moves on guide rail (12). The positioning movement in the direction of the double arrow C is executed by means of the carriage (13) which is likewise driven in a controlled manner. The positioning movements of the two double arrows C and D at the same time preferably form the same angle as the directions C and E in the case of the inking unit (20). It is therefore possible to employ structurally identical cross-slide units (17+19, 13+15) for both uses, thus making economical production possible.

A further cross-slide unit (26+27) is employed for an imaging apparatus (30). Such imaging devices (30) are provided for applying the printing images to the forme cylinders (3, 6) and must therefore be moveable along the cylinder outer surfaces in the direction of the double arrow A. One of these imaging devices (30) is illustrated by way of example on a forme cylinder (3), and a further imaging device is also assigned to the forme cylinder (6). A slide (26) is moveable in a controlled manner in the direction of the double arrow A along a guide 25 located on a crossmemeber (24) aligned parallel to the cylinder axis.

For format matching or for adjustment to different cylinder diameters, a further guide (29) is provided on the slide (26) preferably orthogonally to the cylinder axis. A carriage (27) runs in this guide (29) and has the imaging apparatus (30) which, by means of a controlled activation of the drive of the carriage (27), can be set to the desired distance from the outer surface of the respective cylinder diameter.

The depiction of fixing stations which are assigned to each forme cylinder (3, 6) for fixing the printing image has been dispensed with in this illustration. These fixing stations are likewise built on cross-slide units and allow controlled movements of the fixing stations parallel to the cylinder axes (double arrow A) and format-matching advancing movements to the diameter of the cylinder. Such fixing stations are shown in FIG. 2.

FIG. 2 is a side view which illustrates the forme cylinders (3, 6) both in their position during printing and in a position during imaging (3', 6'). The washing/erasing devices (16) are also illustrated both in their position during washing and erasing and in a parking position (16').

Below the forme cylinder (3'), which is in a position for imaging, is arranged a fixing device (31). The latter is mounted on a further cross-slide unit (33+35) which executes controlled movements along the cylinder axis, that is to say into the drawing plane in this view, and in the radial cylinder direction, for the diameter matching of the fixing device (31), in the direction of the double arrow H. For this purpose, a first guide (32) running parallel to the cylinder axis is provided, which is fastened at both ends to the insides of the side walls (9) or is screwed on the base plate (2). In this guide (32) runs a carriage (33), on which a further guide (34), running in the direction of the double arrow H, is arranged. This carriage can be moved by means of a control unit, in such a way that it moves the fixing device (31) past the entire outer surface of the rotating forme cylinder (3'). The radial position of the fixing device (31) in relation to the cylinder outer surface can be set by means of a slide (35) which is moveable in the guide (34) in the direction of the double arrow H. As can be seen in FIG. 2, the guide (32) is arranged at an inclination to the horizontal, so that the movement of the fixing device (31) for matching to the format of different cylinder diameters runs obliquely to the perpendicular to the baseplate (2).

A structurally identical unit, consisting of a fixing unit (31), a cross-slide unit (33+35) and guides (32, 34), is also provided for the other forme cylinder (6'). Here, above the forme cylinder (6'), the guide (32) is mounted parallel to the base plate (2), and the matching movement, matching to different cylinder diameters in the direction of the double arrow K, runs in a direction perpendicular to the base plate (2). The guide (32) may be fastened to the side walls or to a cover plate not designated in any more detail.

On the left of the upper forme cylinder (6') is illustrated a second imaging apparatus (30). The latter, together with its entire subassembly, consisting of the cross-slide unit (26+27) and guides (25, 29), is structurally identical to the imaging apparatus (30) described in FIG. 1 and is therefore given the same reference symbols. In this design variant, the crossmember (24) is connected to carriers (36) which are fastened to the side walls (9). Other assembly possibilities, for example on the cover plate, may also be envisaged. The inclination of the guide (29) to the horizontal may be different from that of the other imaging unit (30) on the form cylinder (3). The movement of matching the upper imaging apparatus (30) to different cylinder diameters runs in the direction of the double arrow G.

This illustration shows the inking (20) and dampening (23) units which are assigned to each forme cylinder (3, 6) and which can be moved and positioned according to the description relating to FIG. 1. The need for a pair of carriages (17) can be avoided by arranging by the guide rail (18) directly on the slide (8) on which the cylinder mountings are fastened. The movement of throwing on and throwing off the inking (20) and dampening (23) units can be executed by means of the carriages (19) and, instead of the independently controlled movement in the direction of the double arrow C, the inking (20) and dampening (23) units are moved, together with the forme cylinder (3, 6), in the direction of the double arrow B.

Possibilities for movement of the washing/erasing devices (16) assigned to each printing-unit cylinder (3, 4, 5, 6) are also evident from FIG. 2. They can all be moved in the direction of the double arrows D towards the respective cylinder and positioned and also be moved away from the cylinder. The double arrows D preferably run parallel to the base plate (2), but may also run obliquely to this in directions differing from one another.

The washing/erasing devices (16) arranged on the right-hand side are also illustrated in the parking position (16') which is preferably located outside the printing unit (1). This service apparatus (16, 16'), which may be positioned less accurately, can be moved and positioned, for example, by means of pneumatic or hydraulic cylinders. The moveability of the washing/erasing devices (16, 16') in the direction of the double arrows C and L has already been explained by means of an example in relation to FIG. 1 and also applies to all the others. The orientations of the guides (12, 28) according to the double arrows C and L preferably run parallel to one another, but may also form an angle.

Carriages or slides which run in guides without play are basically known from machine-tool building. Flat guides, dovetail guides or other embodiments may be employed. The carriages or slides may be moved and positioned in any desired way by means of motor-operated spindles or linear drives, for which purpose the generally known path-measuring systems can be used. Service equipment which is moved between fixed positions can also be moved between stops by means of pneumatic or hydraulic cylinders.

The controlled coupling of the drives to the displacement or position transducers also makes it possible to execute the remote control of the cross-slide units, for example from operating desks.

The cross-slide unit (26+27) for the imaging apparatus (30) may also be used in the same way on apparatus for the production of printing forms according to DE19961867, to which U.S. 2001/0004864 corresponds. This apparatus is provided for the imaging of printing forms outside printing machines. The imaging apparatus is guided along the outer surface of the cylinder to be imaged, by means of a slide provided in a guide on a crossmember running parallel to the printing forms. When a cross-slide unit (26+27) is used on this apparatus, instead of the slide hitherto employed there, the imaging apparatus used can simply be set to different radial positions and thus adjusted to different formats by means of the upper carriage (27) which can be moved and positioned transversely to the slide (26). By means of the apparatus converted in this way, printing forms having different circumferences can be imaged in a particularly advantageous way.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. Rotary printing machine comprising a side wall defining a side wall plane;

at least one forme cylinder;

moving means for moving said at least one forme cylinder relative to said side wall;

at least one impression cylinder;

moving means for moving said at least one impression cylinder relative to said side wall;

service apparatus arranged adjacent to at least one of said cylinders; and moving means for moving said service apparatus relative to the adjacent cylinder;

at least one of said moving means comprising a cross-slide unit which permits movement relative to said side wall in two transverse directions so that the corresponding at least one of said forme cylinder, said impression cylinder, and said service apparatus is freely positionable in a plane defined by said two transverse directions.

2. The rotary printing machine of claim 1 wherein said cylinders are mounted to said side wall, said moving means for moving said cylinders comprising a pair of first guides arranged on said side wall; and a cross-slide unit for mounting each of said cylinders on a respective said first guide, each said cross-slide unit comprising a first slide which is moveable on the respective said first guide parallel to the side wall plane, a second guide mounted on the first slide, and a second slide moveable on the second guide perpendicular to the side wall plane, said second slide carrying said cylinder.

3. The rotary printing machine of claim 1 wherein said means for moving said service apparatus relative to said cylinders comprises a pair of guides arranged on said side wall; and a cross slide unit mounted on each of said guides for movement in a first direction parallel to said side wall plane, said cross-slide unit comprising a slide mounted for movement in a second direction parallel to said side wall plane and transverse to said first direction, said slide carrying said service apparatus.

4. The rotary printing machine of claim 3 further comprising a base plate which is perpendicular to said side wall plane, said guides running obliquely to the base plate.

5. The rotary printing machine of claim 4 wherein said second direction is parallel to said base plate.

6. The rotary printing machine of claim 3 wherein said service apparatus comprises an inking unit, said cross slide unite carrying said inking unit comprising at least one guide rail, said service apparatus further comprising a dampening unit which is moveable in said second direction on said guide rail.

7. The rotary printing machine of claim 1 wherein said service apparatus comprises an imaging apparatus adjacent to said forme cylinder, said means for moving said imaging apparatus comprising a cross-slide unit, said cross-slide unit comprising a slide which can be moved parallel to said forme cylinder, and a carriage which can be moved radially to said forme cylinder, said imaging apparatus being mounted on said carriage.

8. The rotary printing machine of claim 1 wherein said service apparatus comprises a fixing device adjacent to said forme cylinder, said means for moving said fixing device comprising a cross-slide unit, said cross-slide unit comprising a slide which can be moved parallel to said forme cylinder, and a carriage which can be moved radially to said forme cylinder, said fixing device being mounted on said carriage.

9. The rotary printing machine of claim 1 wherein said service apparatus comprises a camera system adjacent to said forme cylinder, said means for moving said camera system comprising a cross-slide unit, said cross-slide unit comprising a slide which can be moved parallel to said forme cylinder, and a carriage which can be moved radially to said forme cylinder, said camera system being mounted on said carriage.

10. The rotary printing machine of claim 1 wherein said service apparatus comprises a coating apparatus for lithographic material adjacent to said forme cylinder, said means for moving said coating apparatus for lithographic material comprising a cross-slide unit, said cross-slide unit comprising a slide which can be moved parallel to said forme cylinder, and a carriage which can be moved radially to said forme cylinder, said coating apparatus for lithographic material being mounted on said carriage.

11. The rotary printing machine of claim 1 further comprising drive means for remotely operating said at least one cross-slide unit, said drive means comprising at least one of motor spindles, linear drives, pneumatic cylinders, and hydraulic cylinders.

12. The rotary printing machine of claim 1 wherein said at least one of said moving means further comprises a first guide arranged on said side wall, said cross-slide unit comprising a first slide which is mounted for movement in a first direction on said first guide, and a second guide arranged on said first slide, said cross-slide unit further comprising a second slide mounted for movement in a second direction on said second guide, wherein said second direction is traverse to said first direction.

* * * * *